United States Patent [19]

van de Plassche

[11] 3,982,172

[45] Sept. 21, 1976

[54] PRECISION CURRENT-SOURCE ARRANGEMENT

[75] Inventor: Rudy Johan van de Plassche, Eindhoven, Netherlands

[73] Assignee: U.S. Philips Corporation, New York, N.Y.

[22] Filed: Apr. 16, 1975

[21] Appl. No.: 568,726

[30] Foreign Application Priority Data

Apr. 23, 1974 Netherlands ..... 7405441

[52] U.S. Cl. ..... 323/1; 323/4

[51] Int. Cl.[2] ..... G05F 1/56

[58] Field of Search ..... 323/1, 4, 16, 19, 22 R; 330/22, 30 D, 38 M, 40

[56] References Cited

UNITED STATES PATENTS

| | | | |
|---|---|---|---|
| 3,689,752 | 9/1972 | Gilbert | 323/1 UX |
| 3,805,093 | 4/1974 | Hodemaekers | 330/30 D |
| 3,812,434 | 5/1974 | Lommers et al. | 330/30 D |
| 3,848,195 | 11/1974 | Kiko | 330/40 X |
| 3,891,937 | 6/1975 | Bockelmann et al. | 330/30 D |

*Primary Examiner*—A. D. Pellinen

*Attorney, Agent, or Firm*—Frank R. Trifari; Bernard Franzblau

[57] ABSTRACT

A precision current source arrangement with a multiple current source which supplies a number of currents which are identical in a first approximation. These currents are each individually applied to one of the input terminals of a coupling circuit which has an equal number of input and output terminals. By means of a periodic control signal this coupling circuit realizes such a connection pattern between the input and output terminals in a cyclically permuting fashion, that each of the output terminals is coupled to each of the input terminals within a constant cycle time during identical time intervals. By subjecting the currents which appear at these output terminals to a low-pass filter action a number of very accurately identical currents are obtained.

12 Claims, 7 Drawing Figures

PRECISION CURRENT-SOURCE ARRANGEMENT

The invention relates to a precision current-source arrangement for realizing accurately identical currents.

Such precision current-source arrangements, i.e., arrangements which are capable of supplying a number of equal currents with a very high accuracy are needed in various electronic circuit arrangements. For this, a sum current may be employed as a reference current, which sum current is divided into a number of equal currents, but alternatively a reference current may be used which is reproduced a number of times, for example in a manner as effected in the known multiple current-mirror arrangements.

Such circuit arrangements may first of all be employed in digital-to-analog converters, which utilize a number of currents whose magnitude ratio is for example in accordance with the binary code. Depending on the binary signal these currents are then applied to a summation point and with the aid of an operational amplifier provide the corresponding analog signal. Said currents can be realized in a simple manner by cascading a number of current dividing circuits, also called current mirror circuits, as for example described in U.S. Pat. No. 3,766,543.

In such digital-to-analog converters the accuracy of the conversion greatly depends on the accuracy with which the desired currents, specifically the desired current ratios, are realized. The accuracy thereof is for a great part determined by the accuracy of the integration technique with which the transistor configurations of the current dividing circuits are realized. Especially when a standard integration technique is employed, this accuracy is of course subject to a specific limitation, which for example may be assumed to be a few percent.

However, for digital-to-analog converters a higher accuracy is generally required. Hence, it is an object of the invention to provide a precision current-source arrangement by means of which a number of identical currents can be generated with very high accuracy. For this, the invention is characterized in that the arrangement comprises a multiple current source which supplies $n$ approximately identical currents and a coupling circuit with $n$ input terminals and $n$ output terminals. The coupling circuit, by means of a periodic control signal supplied thereto by a clock generator in a cyclically permuting fashion, establishes such a connection pattern between the $n$ input terminals and the $n$ output terminals, that each of the output terminals within a constant cycle time, which is defined by the control signal, is consecutively coupled to each of the input terminals during $n$ identical time intervals and during each time interval each of the output terminals is connected to a separate input terminal.

The arrangement according to the invention is consequently based on a number of currents which in a first approximation are identical and which are supplied by the current source, but whose equality is limited, as stated previously. However, with the aid of the coupling circuit each of said currents is transferred to each of the output terminals in a cyclically permuting fashion. Thus, each of the output terminals of the coupling circuit consecutively carries each of the currents of the current source during identical time intervals. The differences between these currents which are supplied by the current source appear in the currents at the output terminals of the coupling circuit as a ripple around the average value. Each of the currents at these output terminals of the coupling circuit, however, has the same average value. By subsequently passing each of said currents through a low-pass filter, said ripple is eliminated and thus constant currents are obtained which equal each other to a high degree.

The coupling circuit may simply comprise $n$ sub-circuits, each of which sub-circuits comprises $n$ switching elements which each have a first and a second main terminal and a control terminal. The first main terminals of the $n$ switching elements of each individual sub-circuit are connected in common to a separate input terminal and the second main terminals of each of the $n$ switching elements of each individual sub-circuit to a separate output terminal. The control terminals of the $n$ switching elements of each of the sub-circuits receive switching signals, which are derived from the control signal from the clock generator, such that the $n$ switching elements of the sub-circuits constitute a conducting connection in a cyclically permuting fashion. For this, $n$ phase-shifted switching signals are derived from the control signal, which signals are applied to the $n$ switching elements of each sub-circuit.

By cascading a number of precision current-source arrangements according to the invention a multitude of currents can be realized which have a mutual current ratio unequal to unity, which current ratio is very accurately defined. In the case of cascading, the current which appears at a first output terminal of the coupling circuit of a first precision current source arrangement is then employed as a sum current of the multiple current source for the next precision current-source arrangement in the cascade arrangement.

Hereinafter, the invention will be described in more detail with reference to the drawing, in which.

Figure 4:
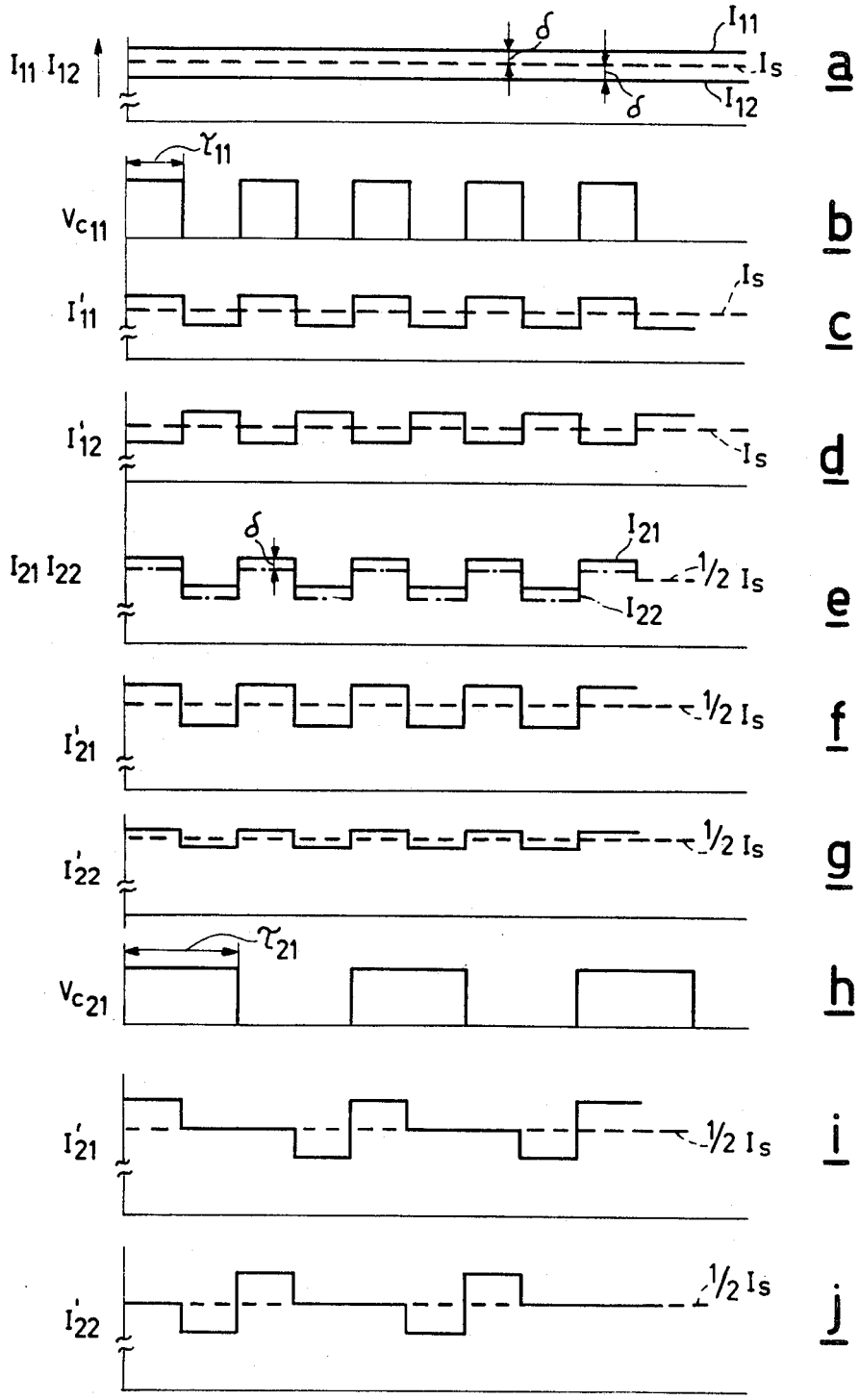

FIG. 4 the associated signal waveforms.

Figure 5:
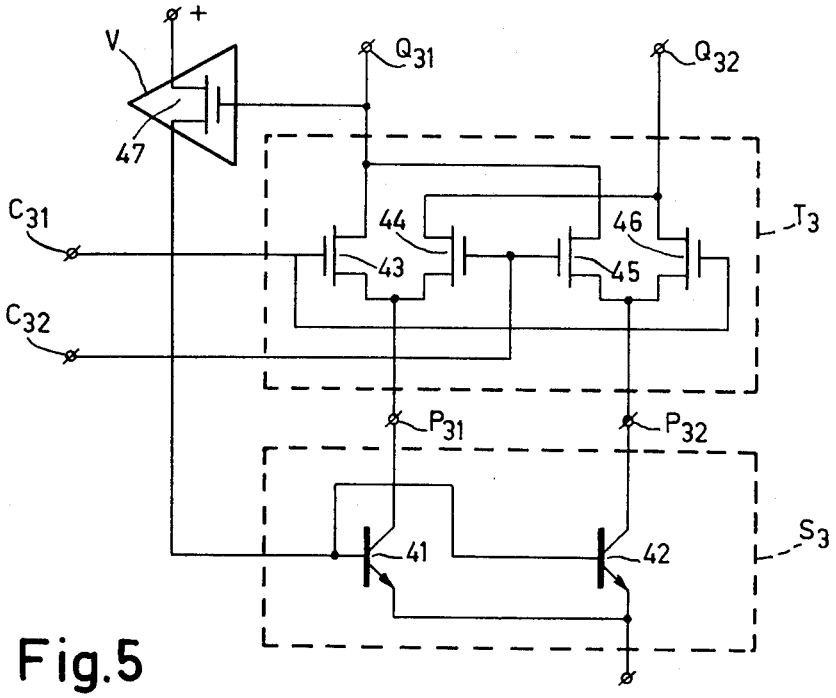
Figure 6:
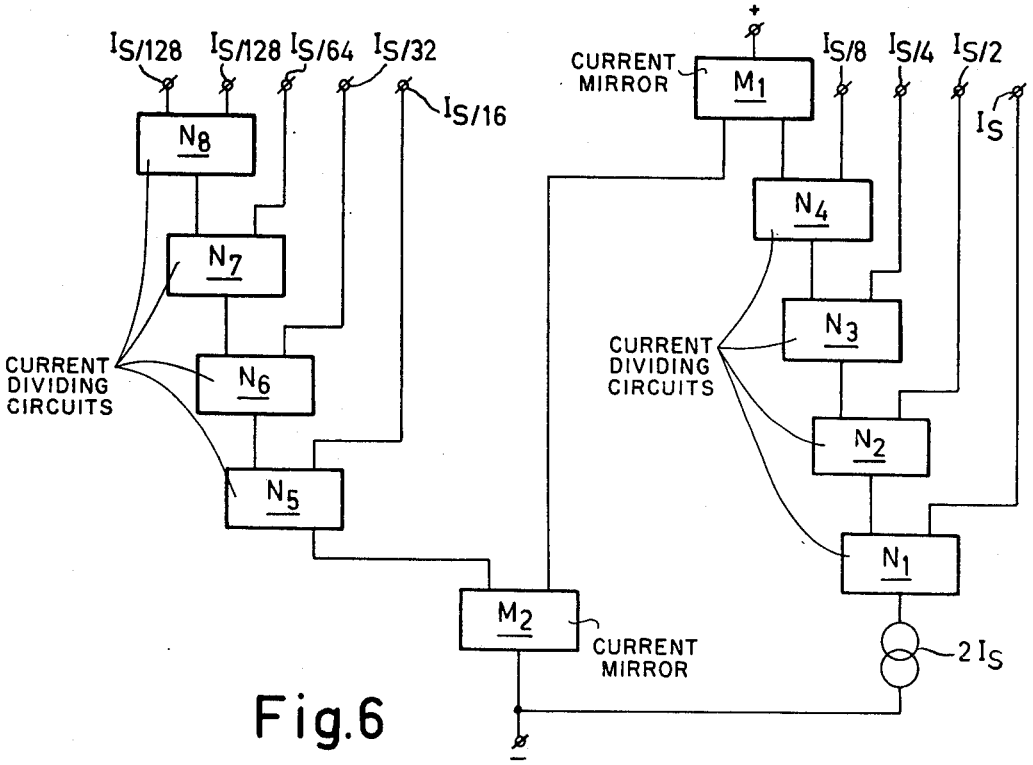

FIG. 5 shows a special embodiment of the precision current-source arrangement according to the invention, and FIG. 6 an application of this special embodiment.

Figure 7:
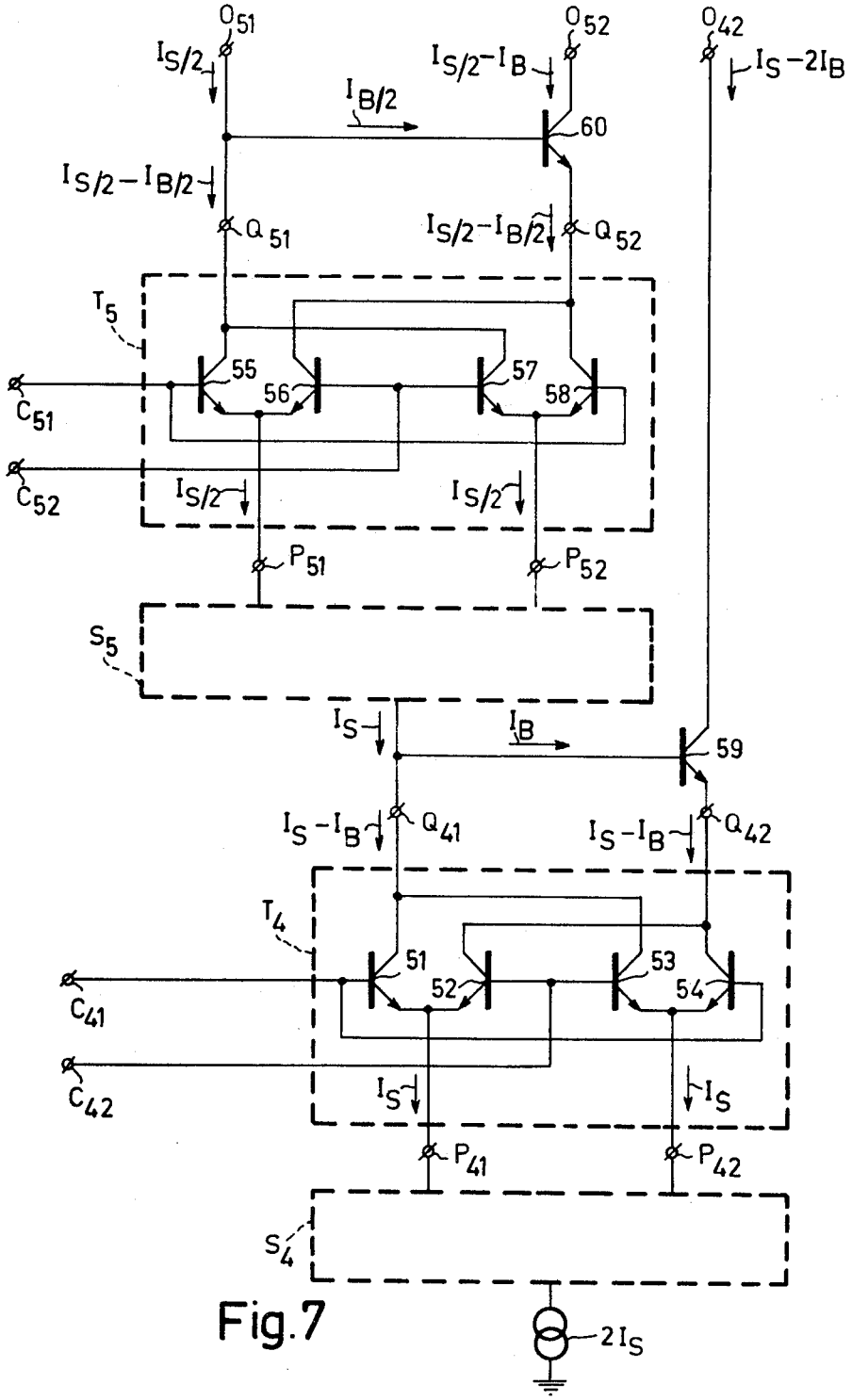

FIG. 7 finally shows two cascaded precision current-source arrangements providing compensation for possible deviations caused by the coupling circuit.

Figure 1:
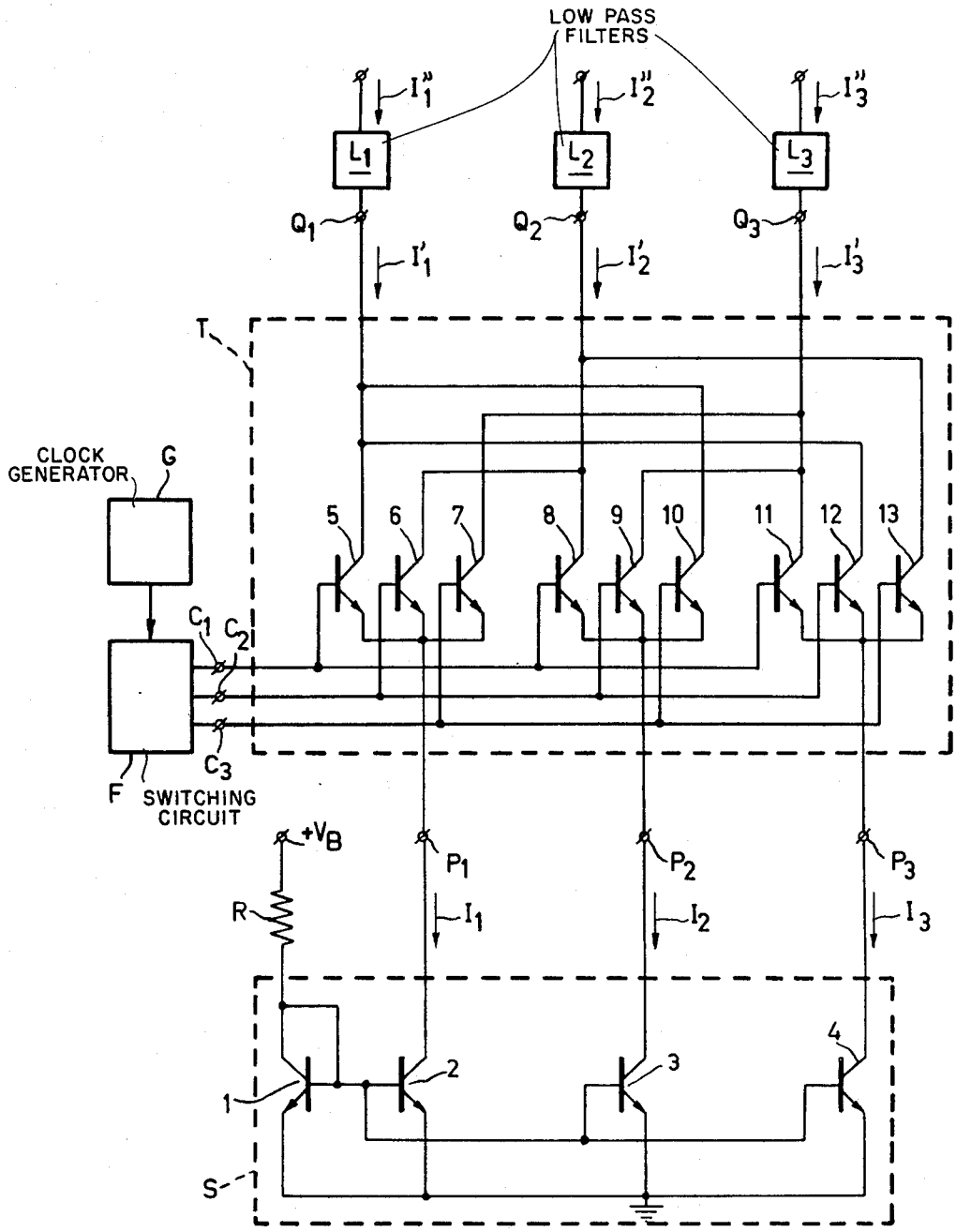
FIG. 1 shows a first embodiment of the precision current-source arrangement according to the invention, and FIG. 2 the associated signal waveforms.

The embodiment of the arrangement according to the invention shown in FIG. 1 is adapted to supply 3 identical currents. The arrangement first of all includes a multiple current source S. This current source S, in known manner, consists of a number of transistors 1, 2, 3 and 4 with parallel-connected base-emitter paths, transistor 1 being connected as a diode and via a resistor R being connected to the positive terminal $+V_B$ of the supply voltage source. The collector currents $I_1$, $I_2$ and $I_3$ of the transistors 2, 3 and 4 are equal to a first approximation when the emitter areas of said transistors are selected to be equal, but deviations may arise as a result of inaccuracies in the integration process of these transistors.

These three currents $I_1$, $I_2$ and $I_3$ are applied to three input terminals $P_1$, $P_2$ and $P_3$ of a coupling circuit T. This coupling circuit T further comprises three output terminals $Q_1$, $Q_2$ and $Q_3$ and in a cyclically permuting fashion establishes a connection between the input terminals $P_1$ through $P_3$ and said output terminals $Q_1$ through $Q_3$. For this purpose the coupling circuit comprises three sub-circuits with the transistors 5, 6 and 7, the transistors 8, 9 and 10, and the transistors 11, 12 and 13 respectively. The emitters of the transistors of each sub-circuit are in common connected to one and the same input terminal, i.e., the emitters of the transistors 5, 6 and 7 to the input terminal $P_1$, the emitters of the transistors 8, 9 and 10 to the input terminal $P_2$ and the emitters of the transistors 11, 12 and 13 to the input terminal $P_3$. The collectors of the transistors of a sub-circuit, however, are each connected to a different output terminal so that the collectors of the transistors 5, 10 and 12 are connected to the output terminal $Q_1$, the collectors of the transistors 6, 8 and 13 to the output terminal $Q_2$ and the collectors of the transistors 7, 9 and 11 to the output terminal $Q_3$.

The transistors in the coupling circuit receive switching signals so that they are selectively turned on and then establish a connection pattern between the input terminals $P_1$, $P_2$, $P_3$ and the output terminals $Q_1$, $Q_2$, $Q_3$. These switching signals are supplied by a switching circuit F, which receives a control signal from a clock generator G, and which at three control terminals $C_1$, $C_2$ and $C_3$ provides three phase-shifted identical switching signals. These control terminals $C_1$, $C_2$ and $C_3$ are connected to the control electrodes of the transistors 5, 8 and 11, the transistors 6, 9 and 12 and the transistors 7, 10 and 13 respectively.

Figure 2:
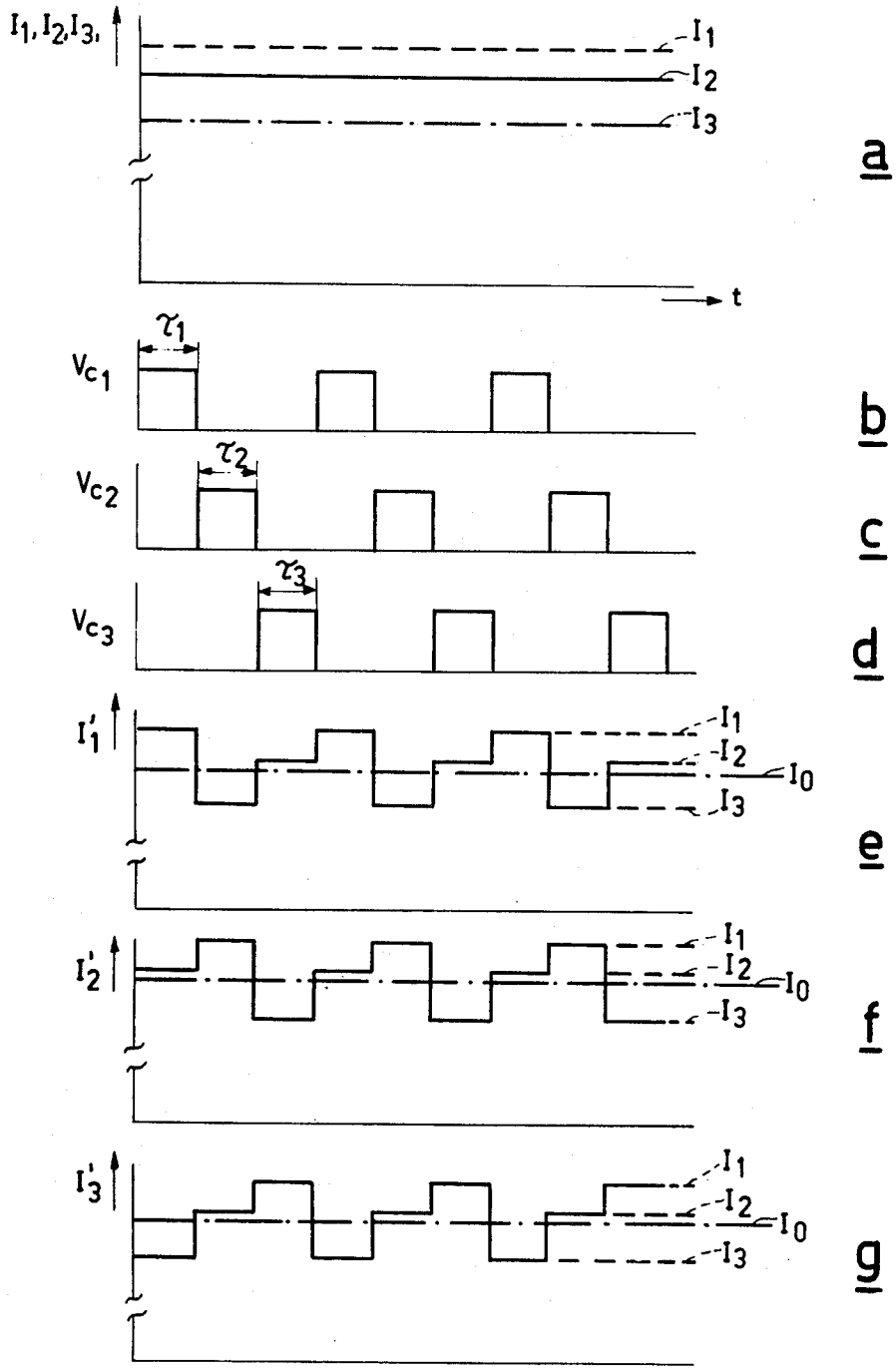

The operation of the arrangement will now be described in more detail with the aid of the waveforms shown in FIG. 2.

It is assumed that the current source S supplies three currents $I_1$, $I_2$ and $I_3$. As already stated, these currents are only identical in a first approximation and exhibit mutual deviations as a result of the limited accuracy with which the transistors 2, 3 and 4 can be made identical to each other. The currents $I_1$, $I_2$ and $I_3$ consequently exhibit mutual deviations, which deviations are not shown in correct proportion relative to the absolute values of the currents, which is schematically indicated by the interruption of the ordinate.

In FIGS. 2*b*, *c* and *d* the three switching signals $V_{c1}$, $V_{c2}$ and $V_{c3}$ are shown, which are applied to the control terminals $C_1$, $C_2$ and $C_3$. These three switching signals are formed by mutually phase-shifted squarewave voltages of mutually equal duration. It is evident from the Figure that at all times one of said switching signals is positive, viz, $V_{c1}$, $V_{c2}$ and $V_{c3}$ in that order. This means that consecutively each time three other transistors of the switching transistors in the coupling circuit are conductive, so that the three input currents $I_1$, $I_2$ and $I_3$ are cyclically available at each of the output terminals $Q_1$, $Q_2$ and $Q_3$ of the coupling circuit.

As an example of the current $I_1'$ at the output terminal $Q_1$, shown in FIG. 2*e*, is considered. During the first time interval $\tau_1$, when the switching signal $V_{c1}$ is positive, transistor 5 conducts so that during this time interval the input current $I_1$ is available at the terminal $Q_1$. During the time interval $\tau_2$, in which the switching signal $V_{c2}$ is positive, the input current $I_3$ is available at the output terminal $Q_1$ because during the time interval $\tau_2$ transistor 12 is conducting. During the third time interval $\tau_3$ the input current $I_2$ finally becomes available at the output terminal $Q_1$ because transistor 10 is then conductive. After this third time interval $\tau_3$ one full cycle is completed.

The current $I_1'$ at the output terminal $Q_1$ consequently exhibits a periodical variation around an average value $I_0$ because the value of said current $I_1'$ consecutively corresponds to the values of the currents $I_1$, $I_3$ and $I_2$. The variation of the currents $I_2'$ and $I_3'$ at the output terminals $Q_2$ and $Q_3$ can be derived in a similar way and is represented in FIGS. 2*f* and 2*g*. The current $I_2'$ during the time intervals $\tau_1$, $\tau_2$ and $\tau_3$ consecutively equals the currents $I_2$, $I_1$ and $I_3$ and the current $I_3'$ equals the currents $I_3$, $I_2$ and $I_1$. It follows directly that the three currents $I_1'$, $I_2'$ and $I_3'$ have an equal average value $$I_0 = \frac{I_1 + I_2 + I_3}{3}$$

and an identical but phase-shifted variation around said average value. These three currents $I_1'$, $I_2'$ and $I_3'$ consequently consist of a direct current $I_0$ on which a certain ripple is present. When subsequently each of these currents $I_1'$, $I_2'$ and $I_3'$ is applied to a low-pass filter $L_1$, $L_2$ and $L_3$ respectively, whose cut-off frequency is substantially lower than the frequency which corresponds to the time intervals $\tau_1$, $\tau_2$ and $\tau_3$, the ripple is removed from these currents and the d.c. component $I_0$ is left. Depending on the choice of the switching frequency and the low-pass filters this yields three currents $I_1''$, $I_2''$ and $I_3''$ which are equal to each other with great accuracy, namely equal to the average value $I_0$.

Figure 3:
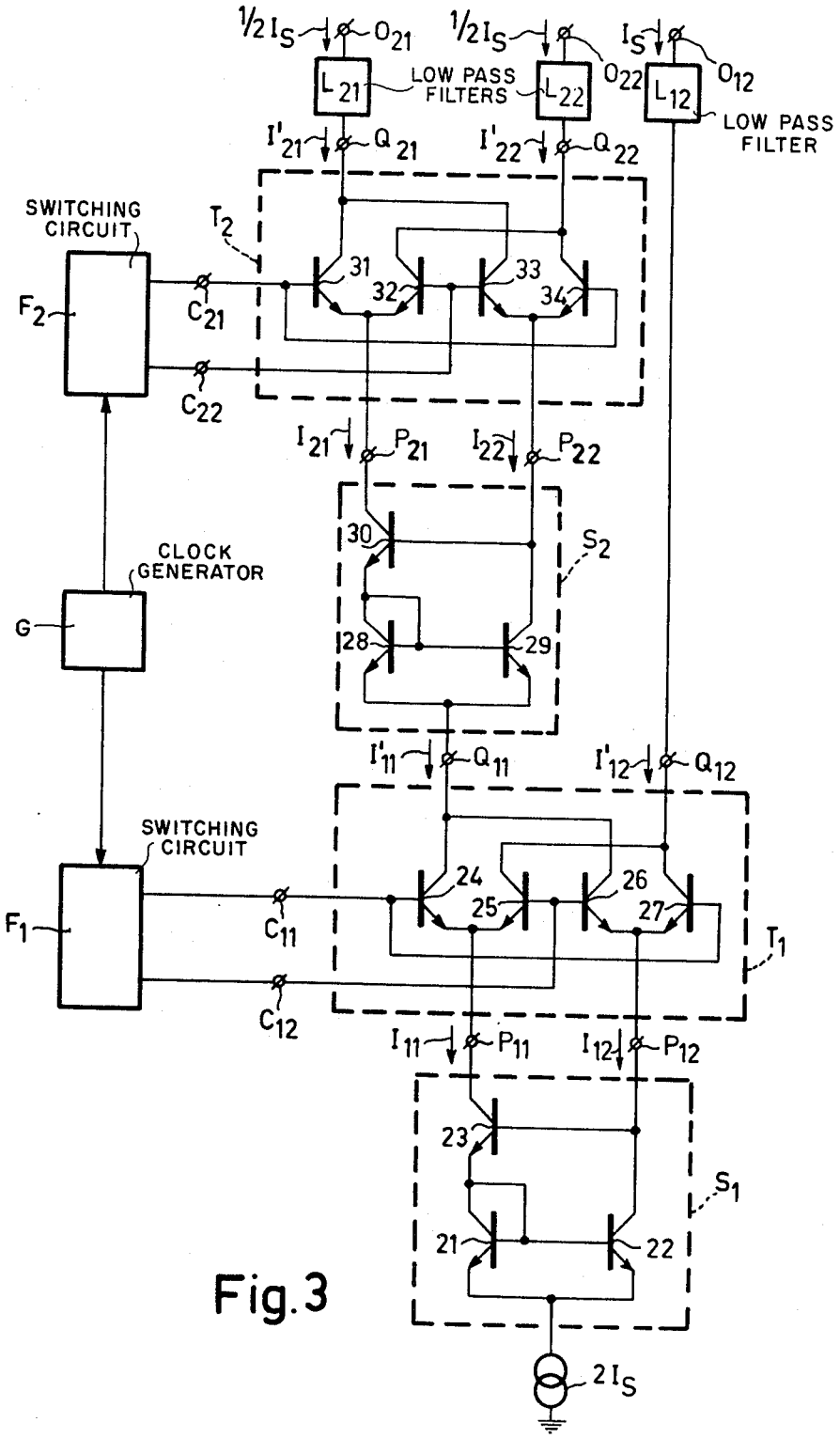
FIG. 3 shows two cascaded precision current-source arrangements.

FIG. 3 shows how using the precision current source arrangement according to the invention, current networks can be realized which are particularly suited for digital-analog and analog-digital converters, while FIG. 4 shows the signal waveforms which appear in the arrangement of FIG. 3. The current network of FIG. 3 first of all comprises a current source $S_1$, which essentially is a commonly known current mirror circuit which consists of the transistors 21, 22 and 23. This current mirror circuit has the property that a current $2I_s$ which is applied to the common emitters of the identical transistors 21 and 22 as a sum current, is split into two currents $I_{11}$ and $I_{12}$ which are identical to a first approximation. These currents are available as collector currents of the transistors 23 and 22. These two currents $I_{11}$ and $I_{12}$ exhibit a mutual deviation (assumed to be $\delta$) relative to the desired value $I_s$ as a result of the limited equality of the transistors which are used (see FIG. 4*a*).

These two currents $I_{11}$ and $I_{12}$ are applied to two input terminals $P_{11}$ and $P_{12}$ of a first coupling circuit $T_1$, which has two output terminals $Q_{11}$ and $Q_{12}$. This coupling circuit comprises four transistors 24, 25, 26 and 27, which are connected two by two with their emitters to the input terminals $P_{11}$ and $P_{12}$, two by two with their collectors to the two output terminals $Q_{11}$ and $Q_{12}$, and two by two with their base electrodes to two control terminals $C_{11}$ and $C_{12}$, in such a way that as a result of two squarewave switching signals of mutually opposite phase which are applied to these control terminals and which are derived from the clock generator G with the aid of a switching circuit $F_1$, the two input currents $I_{11}$ and $I_{12}$ become available at the two output terminals $Q_{11}$ and $Q_{12}$ in a cyclically permuting fashion. FIG. 4*b* shows the switching signal $V_{c11}$ with a period $\tau_{11}$ which is applied to the control terminal $C_{11}$. The switching signal for the control terminal $C_{12}$, which is exactly in phase opposition relative to said switching signal, is not shown for simplicity. The output current $I_{11}'$ at the output terminal $Q_{11}$ is consequently alternately equal to $I_{11}$ and $I_{12}$ (FIG. 4*c*) and the output current $I_{12}'$ at the output terminal $Q_{12}$ is alternately equal to $I_{12}$ and $I_{11}$ (FIG. 4*d*). As a result, these two currents $I_{11}'$ and $I_{12}'$ both consist of a d.c. component $I_s$ having superimposed on it a ripple component of a frequency which equals the switching frequency $1/2\tau_{11}$.

The current $I_{11}'$ in its turn is now applied to a second current source $S_2$ as a sum current, which source is of identical design to the current source $S_1$. This current source $S_2$ consequently divides the current $I_{11}'$ into two currents $I_{21}$ and $I_{22}$ which are identical in a first approximation. As this current source circuit also has a limited accuracy, there will again be a certain deviation between the currents $I_{21}$ and $I_{22}$, of which it is assumed that its relative value equals the deviation which occurred in the first current source circuit. The mutual magnitude-ratio of the deviations from the equality of the output currents occurring in the two current source circuits, however, is irrelevant for the principle of the invention. Owing to the stated choice of the deviation of the second current source circuit, the two currents $I_{21}$ and $I_{22}$ consists of two identically varying currents which have shifted by $\delta$, the current $I_{21}$ having an average value of $\frac{1}{2}I_s + \delta$ and the current $I_{22}$ having an average of $\frac{1}{2}I_s - \delta$.

These two currents $I_{21}$ and $I_{22}$ in their turn are applied to the two input terminals $P_{21}$ and $P_{22}$ of a second coupling circuit $T_2$ which furthermore comprises two output terminals $Q_{21}$ and $Q_{22}$, two control terminals $C_{21}$ and $C_{22}$ and which is of identical design to the first coupling circuit $T_1$. The two currents $I_{21}$ and $I_{22}$ are thus alternately crosswise applied to the output terminals $Q_{21}$ and $Q_{22}$ depending on the switching signals which are applied to the control terminals $C_{21}$ and $C_{22}$. The switching signals applied to these two terminals $C_{21}$ and $C_{22}$ are derived from the clock generator with the aid of a second switching circuit $F_2$.

FIGS. 4*f* and 4*g* show the variation of the currents $I_{21}'$ and $I_{22}'$ in the case where the switching signals which are applied to the control terminals $C_{21}$ and $C_{22}$ are equal to the switching signals $V_{c11}$ and $V_{c12}$. It is obvious that in that case the switching circuit may be dispensed with and the control terminals $C_{21}$ and $C_{22}$ may be connected to the control terminals $C_{11}$ and $C_{12}$ respectively. FIGS. 4*f* and 4*g* show that if the switching frequency for the second coupling circuit $T_2$ equals that of the first coupling circuit, the ripple component which is superimposed on the average value $\frac{1}{2}I_s$ of the two currents $I_{21}'$ and $I_{22}'$ has a different amplitude. This occurs because, for the current $I_{21}'$ the deviations which are caused by the two current sources $S_1$ and $S_2$ are added, whereas for the current $I_{22}'$ these two deviations are opposed. As these ripple components can be removed with the aid of low-pass filters, this fact is insignificant. Thus, by filtering the currents $I_{21}'$, $I_{22}'$ and $I_{12}'$ with the aid of low-pass filters $L_{21}$, $L_{22}$ and $L_{12}$ respectively, currents are obtained at the outputs $O_{21}$, $O_{22}$ and $O_{12}$, which are equal to $\frac{1}{2}I_s$, $\frac{1}{2}I_s$ and $I_s$ respectively, with great accuracy.

FIGS. 4*h* and *j* show the variation of the currents $I_{21}'$ and $I_{22}'$ in the case where the frequency of the switching signals which are applied to the control terminals $C_{21}$ and $C_{22}$ is a factor 2 times lower than the frequency of the switching signals $V_{c11}$ and $V_{c12}$. The switching signal $V_{c21}$ shown in FIG. 4*h* is consequently square-wave-shaped, while the duration of the waves $\tau_{21} = 2\tau_{11}$. Thus, the two input currents $I_{21}$ and $I_{22}$ are alternately transferred to the two output terminals $Q_{21}$ and $Q_{22}$ as a function of said switching signals, which results in the output currents $I_{21}'$ and $I_{22}'$ shown in FIGS. 4*i* and 4*j* at said output terminals. These two Figures clearly show that these two output currents also consist of a d.c. component $\frac{1}{2}I_s$, on which a ripple component is superimposed which is the same for both currents but phase-shifted. When the currents $I_{21}'$, $I_{22}'$ and $I_{12}'$ are applied to low-pass filters $L_{21}$, $L_{22}$ and $L_{12}$, the ripple component will again be filtered out for each of said currents so that the direct currents $\frac{1}{2}I_s$, $\frac{1}{2}I_s$ and $I_s$ become available at the outputs $O_{21}$, $O_{22}$ and $O_{12}$ of said low-pass filters.

Alternatively, the frequency of the switching signals applied to control terminals $C_{21}$ and $C_{22}$ may be selected a factor of two times higher than the switching signals applied to the control terminals $C_{11}$ and $C_{12}$. This also yields currents of the desired average value having superimposed on them a ripple component, which then has a higher frequency. Thus, by cascading two precision current source arrangements according to the invention as shown in FIG. 3, two currents are realized at the terminals $O_{22}$ and $O_{12}$, which with a very high accuracy have the mutual ratio of two, which is required for digital-analog conversion. To obtain more currents which consecutively have this desired mutual ratio, more arrangements according to the invention must be cascaded. For, if the current $I_{21}'$, instead of being applied to a low-pass filter $L_{21}$, is again applied to a current source which is associated with a precision current source arrangement according to the invention, this will again enable two currents whose magnitude is $\frac{1}{4}I_s$ to be accurately derived from this current. Thus, a number of currents $I_s$, $\frac{1}{2}I_s$, $\frac{1}{4}I_s$, $\frac{1}{8}I_s$, etc., may be realized, which are very accurately defined in respect of their mutual ratios and which are therefore extremely suitable for use in a digital-to-analog converter.

FIG. 5 shows a special embodiment of the precision current source arrangement according to the invention. The arrangement again includes a current source $S_3$ which supplies two currents, which to a first approximation are equal, to the input terminals $P_{31}$ and $P_{32}$ of the coupling circuit $T_3$. This coupling circuit $T_3$ is of the same design as the coupling circuits $T_1$ and $T_2$ in FIG. 3, but in this case it is equipped, by way of example, with insulated-gate field-effect transistors 43 through 46. The use of these transistors has the advantage, with respect to the use of bipolar transistors, that the control electrodes and thus the control terminals $C_{31}$ and $C_{32}$ draw no current, so that the switching circuits and clock generator are not loaded.

The characteristic feature of the arrangement is the fact that the current source $S_3$ is driven by an amplifier V, whose input is connected to one of the output terminals $Q_{31}$ of the coupling circuit. In the embodiment shown the amplifier V, by way of example, consists of a single field-effect transistor 47 which drives the base electrodes of the two transistors 41 and 42 in the current source arrangement $S_3$. The base-emitter paths of these transistors are connected in parallel. This design ensures that the circuit arrangement shown functions as an accurate current mirror with terminal $Q_{31}$ as an input terminal and terminal $Q_{32}$ as output, i.e., that a current which is fed to terminal $Q_{31}$ is accurately reproduced at terminal $Q_{32}$. Of course, this is irrespective of the ripple component on the output current, which subsequently is to be eliminated by means of a low-pass filter.

If desired, more than one output current may also be realized. Obviously, the current source arrangement $S_3$ must then include more transistors with parallel-connected base-emitter paths and the coupling circuit must be adapted so as to establish the desired couplings. By adding a number of combinations of output currents to each other this obviously allows various combinations of current ratios to be realized.

The embodiment shown in FIG. 5 is of special significance when a multitude of currents consecutively having a mutual magnitude ratio of two is to be realized. For this a multitude of current dividing circuits, in particular circuits according to the invention, would have to be cascaded. This may present problems in view of the available supply voltage. Each current dividing circuit requires a certain supply voltage, so that the total supply voltage which is required in the case of cascading increases in proportional to the number of cascaded current dividing circuits and may exceed the available supply voltage.

The remedy for this is given in FIG. 6, which shows a circuit by means of which an 8-bit digital-analog converter can be realized. For realizing these 8 bits, eight current dividing circuits are required, each of which, according to the invention, form a combination of a current source circuit and a coupling circuit. Of these eight current dividing circuits, four circuits are cascaded, namely the current dividing circuits $N_1$ through $N_4$, of which $N_1$ receives a current $2I_s$ and which consequently realize the currents $I_s$, $I_s12$, $I_s/4$ and $I_s/8$.

However, the second output current of current dividing circuit $N_4$, whose magnitude equals $I_s/8$, is now applied as an input current to a current mirror circuit $M_1$ according to FIG. 5. The output current of said current mirror circuit $M_1$ in its turn is employed as input current for a second current mirror circuit $M_2$ according to FIG. 5. As a result, a current is obtained at the output of said second current mirror circuit $M_2$ which accurately equals the output current $I_s/8$ of the current dividing circuit $N_4$ and which may be applied to a following cascade connection of four current dividing circuits $N_5$ through $N_8$, which realize the currents $I_s/16$, $I_s/32$, $I_s/64$ and $I_s/128$.

By the use of the current mirrors $M_1$ and $M_2$ it is thus achieved that the total supply voltage need only be proportioned for a cascade connection of four current dividing circuits plus one current mirror, instead of the cascade connection of eight current dividing circuits. It is obvious that the total number of current dividing circuits may also be subdivided differently by the use of more current mirrors.

Furthermore, it is to be noted that for simplicity the control terminals for the current dividing circuits $N_1$ through $N_8$ and the two current mirror circuits $M_1$ and $M_2$ are not shown.

FIG. 7 finally shows an embodiment, in which a compensation is provided for deviations of the desired current ratios caused by the base currents in the case that bipolar transistors are used. The Figure shows two cascaded current dividing circuits with the current sources $S_4$ and $S_5$ and the coupling circuits $T_4$ and $T_5$. For simplicity it is assumed that the current division realized by the current source circuits is perfect. The current $2I_s$ which is applied to the current source circuit $S_4$ is divided into two currents $I_s$, which are applied to the two input terminals of the coupling circuit $T_4$. Each of the transistors 51 through 54 will carry a base current of, say, $I_B$ during the time that it conducts, so that the currents at the two output terminals $Q_{41}$ and $Q_{42}$ are equal to $I_s - I_B$.

If one of these currents were applied to the current source circuit $S_5$, currents equal to $I_s/2 - I_B/2$ would appear at the input terminals $P_{51}$ and $P_{52}$ of the coupling circuit $T_5$. As the transistors 55 through 58 now carry a base current $I_B/2$ in the conductive state, currents equal to $I_s/2 - I_B$ would now appear at the output terminals $Q_{51}$ and $Q_{52}$ of the coupling circuit $T_5$. The ratio between these two currents and the current at the terminal $Q_{42}$ of the coupling circuit $T_4$ no longer equals exactly two owing to the base currents $I_B$, but is $$\frac{I_s/2 - I_B}{I_s - I_B} = 2 - \frac{1}{2\left(\frac{I_s}{I_B} - 1\right)}$$

In order to prevent this deviation from the desired ratio of the currents owing to the base currents of the switching transistors, two compensation transistors have been added, namely transistor 59 and transistor 60. The collector-emitter path of transistor 59 is then included between a terminal $O_{42}$ and the output terminal $Q_{42}$ of the coupling circuit $T_4$ and its base is connected to the output terminal $Q_{41}$. In a similar way the collector-emitter path of transistor 60 is included between a terminal $O_{52}$ and the output terminal $Q_{52}$ of the coupling circuit $T_5$ and its base is connected to the output terminal $Q_{51}$.

When it is assumed that these two transistors have the same current gain factor as the switching transistors, the base current of transistor 59 will equal $I_B$ to a first approximation. The current at terminal $O_{42}$ consequently becomes $I_s - 2I_B$ and the current for the current source circuit $S_5$ becomes $I_s$. This current $I_s$ is divided into two currents $I_s/2$ at the input terminals $P_{51}$ and $P_{52}$ of the coupling circuit $T_5$, which results in two currents $I_s/2 - I_B/2$ at the output terminals $Q_{51}$ and $Q_{52}$ of this coupling circuit. If the base current of transistor 60 in a first approximation is assumed to be $I_B/2$, the current at terminal $O_{51}$ equals $I_s/2$ and the current at terminal $O_{52}$ equals $I_s/2 - I_B$.

Consequently, the ratio of the currents at the terminals $O_{52}$ and $O_{42}$ is $$\frac{I_s/2 - I_B}{I_s - 2I_B} = 2,$$

from which it is evident that the adverse effect of the base current of the switching transistors on the desired current ratio has been largely eliminated.

When switching transistors are employed with a very high current gain factor it is obvious that such compensation steps are not necessary. Particularly suited for this are insulated-gate field-effect transistors which, as is known, require no base current.

It will be evident that the scope of the invention is not limited to the embodiments of the precision current source arrangements shown in the Figures. For those skilled in the art there are many known methods in which a number of currents which are identical in a first approximation can be realized. Therefore, the current source required in the precision current-source arrangement according to the invention by no means need be of the design shown in the Figures, which is most commonly known.

For those skilled in the art various modifications of the coupling circuit will also be known. Even mechanical switches are conceivable, although because the switching frequency will generally be selected high, electronic switches are to be preferred.

Furthermore, the switching signals required for the coupling circuit may be produced in different ways, inter alia in dependence on the number of currents which is realized with the aid of the precision current source arrangement. When this number is two, only two symmetrical squarewave voltages which are mutually in phase opposition are required as switching signals, which of course may simply be realized with an astable multivibrator.

If more, say *n*, switching signals are required, these switching signals can be obtained very simply with the aid of a shift register, for example a bucket brigade, a CCD (charge-coupled device) or an SCT (surface charge transistor), consisting of n elements and in which the output is again coupled to the input. By transferring a standard voltage from the one element to the next element with the aid of a pulse train which is supplied by the clock generator, *n* switching signals are obtained at the output of the respective elements, which signals are suitable to be applied to the coupling circuit.

What is claimed is:

1. A precision current source arrangement for producing n accurately identical currents comprising, a multiple current source which supplies *n* approximately identical currents, a coupling circuit with *n* input terminals coupled to said multiple current source and *n* output terminals, means including a clock generator for coupling a periodic control signal to the coupling circuit in a cyclically permuting fashion, said coupling circuit including means responsive to the periodic control signal for selectively interconnecting said *n* input terminals with said *n* output terminals so as to establish a connection pattern between the *n* input terminals and the *n* output terminals such that each of the output terminals within a constant cycle time, which is defined by the control signal, is consecutively coupled to each of the input terminals during *n* identical time intervals and during each time interval each of the output terminals is coupled to a separate input terminal.

2. A precision current source arrangement as claimed in claim 1, characterized in that the coupling circuit consists of *n* sub-circuits, each of which subcircuits comprises *n* switching elements which each have a first and a second main terminal and a control terminal, means connecting the first main terminals of the *n* switching elements of each individual sub-circuit in common to a separate input terminal and the second main terminals of each of the *n* switching elements of each individual sub-circuit to a separate output terminal, and the control terminals of the *n* switching elements of each of the sub-circuits receive switching signals derived from the control signal from the clock generator such that the *n* switching elements of the sub-circuits constitute a conducting connection in a cyclically permuting fashion.

3. A precision current source arrangement as claimed in claim 1, characterized in that the current source comprises *n* parallel branches which each include the main current path of a transistor, the control electrodes of said transistors receiving a common control signal supplied by an amplifier having an input coupled to an output terminal of the coupling circuit, and means for applying to said output terminal a reference current.

4. A cascade arrangement of a number of precision current source arrangements as claimed in claim 1, characterized in that the current which appears at a first output terminal of the coupling circuit of a first precision current source arrangement is used as sum current for the multiple current source of a subsequent precision current-source arrangement.

5. A cascade arrangement of two precision current source arrangements of the type as claimed in claim 1 wherein each of the precision current source arrangements has two output terminals and produces two identical currents, characterized in that the current which appears at a first output terminal of the coupling circuit of a first precision current source arrangement is used as a sum current for the multiple current source of a second precision current source arrangement, means connecting the first output terminal of the coupling circuit of the first precision current source arrangement to the control electrode of a first transistor whose main current path is traversed by a current which is obtained from the second output terminal of the relevant coupling circuit, and means connecting a first output terminal of the coupling circuit of the second precision current source arrangement to the control electrode of a second transistor whose main current path is traversed by a current obtained from the second output terminal of the relevant coupling circuit, the selective interconnecting means of the coupling circuits comprising a plurality of transistor switching elements, said first and second transistors having at least approximately the same current gain as the transistors which are employed as switching elements in the coupling circuit.

6. A precision current source arrangement as claimed in claim 1 wherein said multiple current source includes means for supplying n constant currents approximately equal to one another at *n* terminals thereof during said *n* identical time intervals of a given cycle time interval, and further comprising low-pass filter means coupled to receive the identical currents supplied by the precision current source arrangement.

7. A current source apparatus for producing a plurality of n substantially equal constant currents comprising, multiple current source means having *n* outputs and means for providing *n* approximately equal constant currents at said *n* outputs, a coupling circuit including *n* input terminals individually coupled to the *n* outputs of said multiple current source means and *n* output terminals, said coupling circuit further comprising a plurality of controlled switching elements for selectively interconnecting said *n* input terminals with said *n* output terminals, means for generating a cyclically permuting periodic control signal providing *n* equal time intervals per cycle, and means for applying said periodic control signal to said coupling circuit thereby to selectively switch the switching elements in a pattern so that during a given cycle of the periodic control signal each of the *n* output terminals is sequentially connected to each of the *n* input terminals during *n* equal time intervals and with each output terminal connected to an individual input terminal during each of said *n* time intervals.

8. Apparatus as claimed in claim 7 wherein said multiple current source means comprises a current mirror circuit having a first terminal coupled to a source of reference current and said $n$ outputs at which said $n$ approximately equal constant currents appear.

9. Apparatus as claimed in claim 7 wherein $n$ is at least two, said apparatus comprising a second current source apparatus for producing a plurality of $n$ substantially equal constant currents and similar to the first such current source apparatus, means for coupling the output current at a first output terminal of the coupling circuit of the first current source apparatus to an input terminal of the multiple current source means of the second current source apparatus, and first and second output lines coupled to the second output terminal of the coupling circuit of the first current source apparatus and to one of the output terminals of the coupling circuit of the second current source apparatus, respectively, whereby first and second constant output currents in a fixed ratio not equal to unity appear at said first and second output lines.

10. Apparatus as claimed in claim 9 further comprising, a first transistor connected in series between said first output line and the second output terminal of the coupling circuit of the first current source apparatus and with its control electrode connected to the first output terminal of the coupling circuit of the first current source apparatus, and a second transistor connected in series with one output terminal of the coupling circuit of the second current source apparatus and with its control electrode connected to a second output terminal of the coupling circuit of the second current source apparatus.

11. Apparatus as claimed in claim 7 wherein the multiple current source means comprises $n$ transistors connected in parallel with their control electrodes connected together in common, an amplifier having an input coupled to one output terminal of the coupling circuit and an output coupled to said common connection of control electrodes of the transistors, and means for applying an external reference current to said one output terminal of the coupling circuit.

12. Apparatus as claimed in claim 7 wherein said periodic control signal generating means includes means for supplying $n$ rectangular waveform signals at $n$ output leads during $n$ mutually exclusive time intervals in a given cycle of the control signal generating means.

* * * * *